US011324976B2

(12) United States Patent
Wechsler

(10) Patent No.: US 11,324,976 B2
(45) Date of Patent: May 10, 2022

(54) PUMP GUARD AND METHODS OF USE THEREOF

(71) Applicant: Thomas Wechsler, Decatur, GA (US)

(72) Inventor: Thomas Wechsler, Decatur, GA (US)

(73) Assignee: WECHSLER ENGINEERING AND CONSULTING, Decatur, GA (US)

( * ) Notice: Subject to any disclaimer, the term of this patent is extended or adjusted under 35 U.S.C. 154(b) by 315 days.

(21) Appl. No.: 16/482,527

(22) PCT Filed: Feb. 12, 2018

(86) PCT No.: PCT/US2018/017886
§ 371 (c)(1),
(2) Date: Jul. 31, 2019

(87) PCT Pub. No.: WO2018/148694
PCT Pub. Date: Aug. 16, 2018

(65) Prior Publication Data
US 2020/0222734 A1 Jul. 16, 2020

Related U.S. Application Data

(60) Provisional application No. 62/458,188, filed on Feb. 13, 2017.

(51) Int. Cl.

| | |
|---|---|
| ***A62C 3/00*** | (2006.01) |
| ***A62C 99/00*** | (2010.01) |
| *A62C 31/02* | (2006.01) |
| *A62C 37/36* | (2006.01) |
| *F04D 13/02* | (2006.01) |
| *F04D 15/00* | (2006.01) |

(52) U.S. Cl.
CPC ..... *A62C 3/00* (2013.01); *A62C 99/0036* (2013.01); *A62C 31/02* (2013.01); *A62C 37/36* (2013.01); *F04D 13/021* (2013.01); *F04D 15/0077* (2013.01)

(58) Field of Classification Search
CPC ..... A62C 3/00; A62C 99/0036; A62C 31/02; A62C 37/36; F04D 13/021; F04D 15/0077; F04D 13/02
USPC ..... 415/180
See application file for complete search history.

(56) References Cited

U.S. PATENT DOCUMENTS 2,888,188 A 5/1959 Hersh
3,280,750 A * 10/1966 White ..... F04D 13/0613 417/357

(Continued)

OTHER PUBLICATIONS

International Search Report and Written Opinion dated Apr. 27, 2018 for corresponding PCT Application No. PCT/US2018/017886.

*Primary Examiner* — Qingzhang Zhou
(74) *Attorney, Agent, or Firm* — Mathew L. Grell; Grell & Watson Patent Attorneys LLC

(57) ABSTRACT

A pump combination guard and methods of use thereof, having an inner housing or guard configured to cover mechanical seal assembly and the motor coupling housed between a drive motor and a fluid pump to enable foam spray nozzles to be directly inserted into the coupling guard housings for fire suppression and an outer "Air scoop" housing or guard configured to direct motor induced airflow over the mechanical seal assembly thereby enabling fire protection and cooling to extend seal life and to protect mechanical seals from pre-mature failure.

22 Claims, 13 Drawing Sheets

(56) References Cited

U.S. PATENT DOCUMENTS

| | | | | |
|---|---|---|---|---|
| 3,704,078 | A * | 11/1972 | Conery | H02K 5/128 310/87 |
| 3,738,781 | A * | 6/1973 | Hagemann | F04D 7/06 415/112 |
| 5,562,406 | A | 10/1996 | Ooka et al. | |
| 8,531,070 | B2 * | 9/2013 | Takeda | F04D 13/064 310/71 |
| 2006/0204361 | A1 * | 9/2006 | Xie | F04D 25/082 415/182.1 |
| 2010/0272560 | A1 * | 10/2010 | Buell | F04D 29/5893 415/180 |

* cited by examiner

PUMP GUARD AND METHODS OF USE THEREOF

CROSS-REFERENCE TO RELATED APPLICATIONS

To the full extent permitted by law, this application is a U.S. national stage filing under 35 U.S.C. § 371 of International Application No. PCT/US2018/017886 filed Feb. 12, 2018 entitled "PUMP GUARD AND METHODS OF USE THEREOF", which claims priority to and the full benefit of United States Provisional Application entitled "PUMP SEAL LIFE IMPROVEMENT AND FIRE PROTECTION APPARATUS AND SYSTEM AND METHODS OF USE THEREOF," having assigned serial number 62/458,188, filed on Feb. 13, 2017, which are incorporated herein by reference in their entirety.

TECHNICAL FIELD

This disclosure relates to a pump guard and methods of use thereof. More specifically the disclosure relates to a fire protection shield for a mechanical seal assembly and coupler between a drive motor and fluid pump.

BACKGROUND

Fluid pumps are utilized in a variety of industries to move fluids and to pressurize fluids. Some pump system require pump protection systems, for example, when involving the operation of pumps handling flammable fluids, such as a pump for an organic flammable liquid with mechanical seals. These pumps are generally operating at elevated temperatures, where leakages of fluid around the pump mechanical seal area, which is common, may provide a source of fire. Seal degradation and failure is accelerated by high temperatures, which organic fluids are commonly operated at, leading to a seal failure, which in turn may lead to a source of fire or an actual fire. This fire once started at the pump may spread to other parts of the plant, and is one of the most common fire hazards associated with this type of pump operation.

One disadvantage is that the manufactures of the individual components of a fluid pump system, such as the mechanical seal assembly, coupler, motor and fluid pump are often manufactured separately and therefore the above fire protection issues have generally not been addressed by the component manufacture. Make shift solutions have been used generally by either pump skid integrators or more common by users/operators themselves.

One approach includes attempts to improve cooling of mechanical seals in order to increase their longevity have generally included modifying or replacing coupling guards to direct motor air to flow over the pump seal thereby cooling it. Coupling guards are generally a metal shield whose function is to protect users from accessing the rotating coupling and shaft connecting motor and pump. While these modifications to the coupling guard may have provided the desired cooling effect, one disadvantage to this approach is abundant air flow to fan a fire, and should the seal begin to leak, thereby promoting the fire, and aiding in its spread.

Another approach to mitigate pump fires has been to place heat, smoke, and fire sensing equipment and water sprays or fire suppressing foam spray delivery systems proximate the pump seal area which automatically discharge in the event of a sensed fire. Some systems have been observed by which the foam spray nozzles have been directly inserted into the coupling guard housings which may be more effective than the more generalized nozzle placement. These fire mitigation systems have been limited in effectiveness as the area to be covered for fire protection is not limited, and these nozzles alone positioned proximate the mechanical seal do not provide a system to contain the spread of fire. These fire suppression systems have addressed the fire once it breaks out, none have addressed the cooling and longevity of the seals themselves to help prevent leakage.

Moreover, none of the above systems as described have been observed to be commercially available. Further, none have addressed the simultaneous needs to address air cooling needed to extend seal life and to protect mechanical seals from pre-mature failure, due to heating, while additionally mitigating its effect to fan the fire, and once failed to prevent fluid spread, a fire from igniting the discharging flammable liquid, suppress any fire which may have started and the spread of fire beyond the mechanical seal.

Therefore, it is readily apparent that there is a need for a pump guard and methods of use thereof that functions to enable a combination of features including address the simultaneous needs to address air cooling to extend seal life and to protect mechanical seals from pre-mature failure, due to heating, while additionally mitigating the cooling air flow effect to fan the fire, and once failed to prevent fluid spread, a fire from igniting the discharging flammable liquid, and suppress any fire which may have started and the spread of fire beyond the mechanical seal.

BRIEF SUMMARY

Briefly described, in an example embodiment, the present disclosure overcomes the above-mentioned disadvantages and meets the recognized need for a pump guard and methods of use thereof, that generally includes an inner housing or guard configured to the cover mechanical seal assembly and the motor coupling housed between a drive motor and a fluid and an outer "Air scoop" housing or guard configured to direct motor induced airflow over the mechanical seal assembly.

According to its major aspects and broadly stated, the present disclosure in its exemplary form is a pump guard and methods of use thereof, that generally includes an inner housing or guard configured to the cover mechanical seal assembly and the motor coupling housed between a drive motor and a fluid pump to enable foam spray nozzles to be directly inserted into the coupling guard housings for fire suppression and an outer "Air scoop" housing or guard configured to direct motor induced airflow over the mechanical seal assembly thereby cooling it to extend seal life and to protect mechanical seals from pre-mature failure.

In an exemplary embodiment, the pump guard and methods of use may include a shroud for a motor, motor-pump coupler, pump mechanical seal assembly, and pump, the fire containment and cooling including an outer housing configured as an air scoop for a first zone to direct cooling air from the motor over the pump mechanical seal assembly, the outer housing formed of a first outer housing side wall and a second outer housing side wall, and a first arching top connected thereto the first outer housing side wall and the second outer housing side wall, and an inner housing positioned within the outer housing and configured to seal a second zone thearound the motor, motor-pump coupler, and pump mechanical seal assembly, the inner housing formed of a platform, extending therefrom a first inner housing side wall and a second inner housing side wall, and a second arching top connected thereto the first inner housing side wall and the second inner housing side wall, and one or more end equipment seals connected thereto the platform, the first inner housing side wall and the second inner housing side wall, and the second arching top.

In another exemplary embodiment, the pump guard and methods of use may include a fire containment and cooling system, the system includes a motor, a motor-pump coupler, a pump mechanical seal assembly, a pump, an outer housing configured as an air scoop for a first zone to direct cooling air from the motor over the pump mechanical seal assembly, the outer housing formed of a first outer housing side wall and a second outer housing side wall, and a first arching top connected thereto the first outer housing side wall and the second outer housing side wall, and an inner housing positioned within the outer housing and configured to seal a second zone around the motor, the motor-pump coupler, and the pump mechanical seal assembly, the inner housing formed of a platform, extending therefrom a first inner housing side wall and a second inner housing side wall, and a second arching top connected thereto the first inner housing side wall and the second inner housing side wall, and one or more end equipment seals connected thereto the platform, the first inner housing side wall and the second inner housing side wall, and the second arching top.

In still a further exemplary embodiment of the pump guard and methods of use, a method of fire containment and cooling, the method includes providing a shroud having a motor, a motor-pump coupler, a pump mechanical seal assembly, a pump, an outer housing configured as an air scoop for a first zone to direct cooling air from the motor over the pump mechanical seal assembly, the outer housing formed of a first outer housing side wall and a second outer housing side wall, and a first arching top connected thereto the first outer housing side wall and the second outer housing side wall, and an inner housing positioned within the outer housing and configured to seal a second zone thearound the motor, the motor-pump coupler, and the pump mechanical seal assembly, the inner housing formed of a platform, extending therefrom a first inner housing side wall and a second inner housing side wall, and a second arching top connected thereto the first inner housing side wall and the second inner housing side wall, and one or more end equipment seals connected thereto the platform, the first inner housing side wall and the second inner housing side wall, and the second arching top, providing an inner housing aperture configured with a fire sensing device therein the second zone, and monitoring the second zone for a fire.

A feature of the pump guard and methods of use is the ability to provide a combination shield or guard such as an inner housing, as well as an outer air scoop housing.

Another feature of the pump guard and methods of use is the ability to provide an inner housing to cover the rotating units of the pump-motor coupling and the pump mechanical seal assembly, such that it is isolated from air flows, and durable enough to contain a fire that may emanate from the pump seal or mechanical seal assembly.

Yet another feature of the pump guard and methods of use is the ability to contain or position therein the inner housing, cover, or guard any fire suppression nozzles, should they be used.

Yet another feature of the pump guard and methods of use is the ability to configure the inner housing, cover, or guard of a flame and heat resistant material such that it could limit a fire's spread.

Yet another feature of the pump guard and methods of use is the ability to position therein the inner housing, cover, or guard fire suppression nozzles and fire sensing lines or other apparatus to extinguish a fire.

Yet another feature of the pump guard and methods of use is the ability to provide fire suppressant via the nozzles, such as water or foam based or may use other fire suppressing fluids or substances.

Yet another feature of the pump guard and methods of use is the ability to contain foam or other extinguishing agent in the inner housing.

Yet another feature of the pump guard and methods of use is the ability to provide catch or drip trays, liners or edging constructed to collect drips from leaks of pump mechanical seal and/or foam fire agents to limit spread of fires.

Yet another feature of the pump guard and methods of use is the ability to provide a confined inner space in which any fire may be contained, should it be initiated by a mechanical seal leak.

Yet another feature of the pump guard and methods of use is the ability to provide a confined inner space in which air flow may be restricted, should a fire be initiated by a mechanical seal leak.

Yet another feature of the pump guard and methods of use is the ability to provide an outer air scoop housing, cover, or guard configured to surround the inner housing.

Yet another feature of the pump guard and methods of use is the ability to provide an outer air scoop housing, cover, or guard configured to capture cooling air from the motor fan, or any other fan, and to direct the airflow over the inner housing toward the pump seal or mechanical seal assembly to provide the desired cooling effect for the pump seal or mechanical seal assembly.

Yet another feature of the pump guard and methods of use is the ability to provide an outer air scoop housing, cover, or guard configured to provide airflow cooling for instrumentation used to monitor the pump seal conditions, such as vibration sensors or other instrumentation which may be placed on or near pump seals or mechanical seal assembly and exposed to high temperatures around the pump seal area. These instruments may be for preventive purposes to monitor pump and/or seal conditions before the pump and/or seal progress to an unstable state.

Yet another feature of the pump guard and methods of use is the ability to provide an inner and outer housing, cover, or guard configured to isolate the cooling air flow from the pump seal area so as not to feed air to or fanning a fire, while still providing protective functions of an inner housing that limit access to rotating components and prevent spread of any fires from the pump mechanical seal area where a leak or fire may occur.

Yet another feature of the pump guard and methods of use is the ability to provide inner and outer housing, cover, or guard configured to fit, placed over, or positioned on any conventional pump-motor arrangement and fitted to new or existing pump-motor systems.

These and other features of the pump guard and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present pump guard and methods of use will be better understood by reading the Detailed Description of the Preferred and Selected Alternate Embodiments with reference to the accompanying drawing Figures, in which like reference numerals denote similar structure and refer to like elements throughout, and in which.

DETAILED DESCRIPTION

In describing the exemplary embodiments of the present disclosure, as illustrated in FIGS. 1A, 1B, 1C, 2A, 2B, 2C, 2D, 2E, 3A, 3B, 3C, 3D, and 4 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1A:
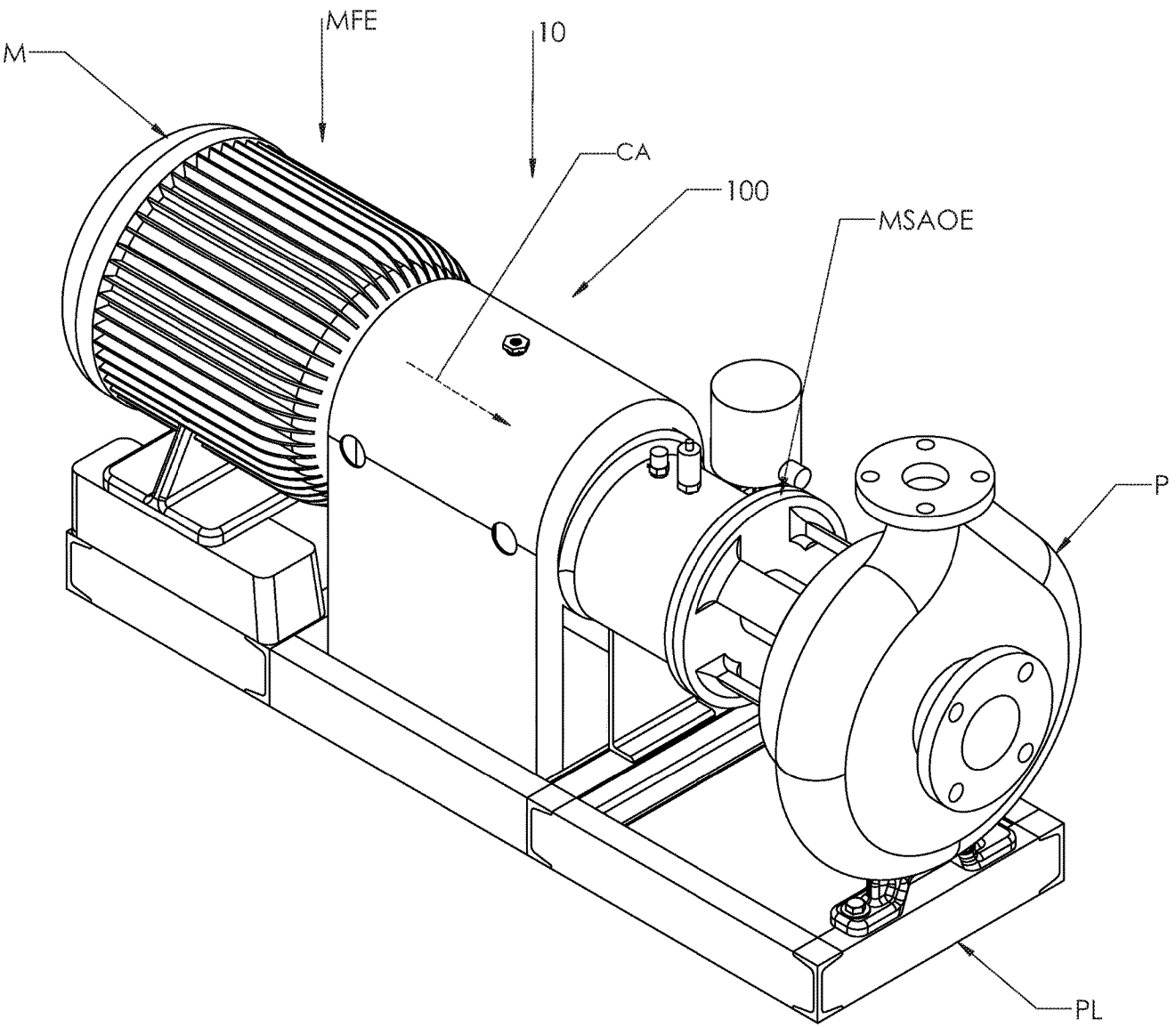
FIG. 1A is a perspective view of an exemplary embodiment of the pump guard fitted to a motor-pump assembly.
Figure 1B:
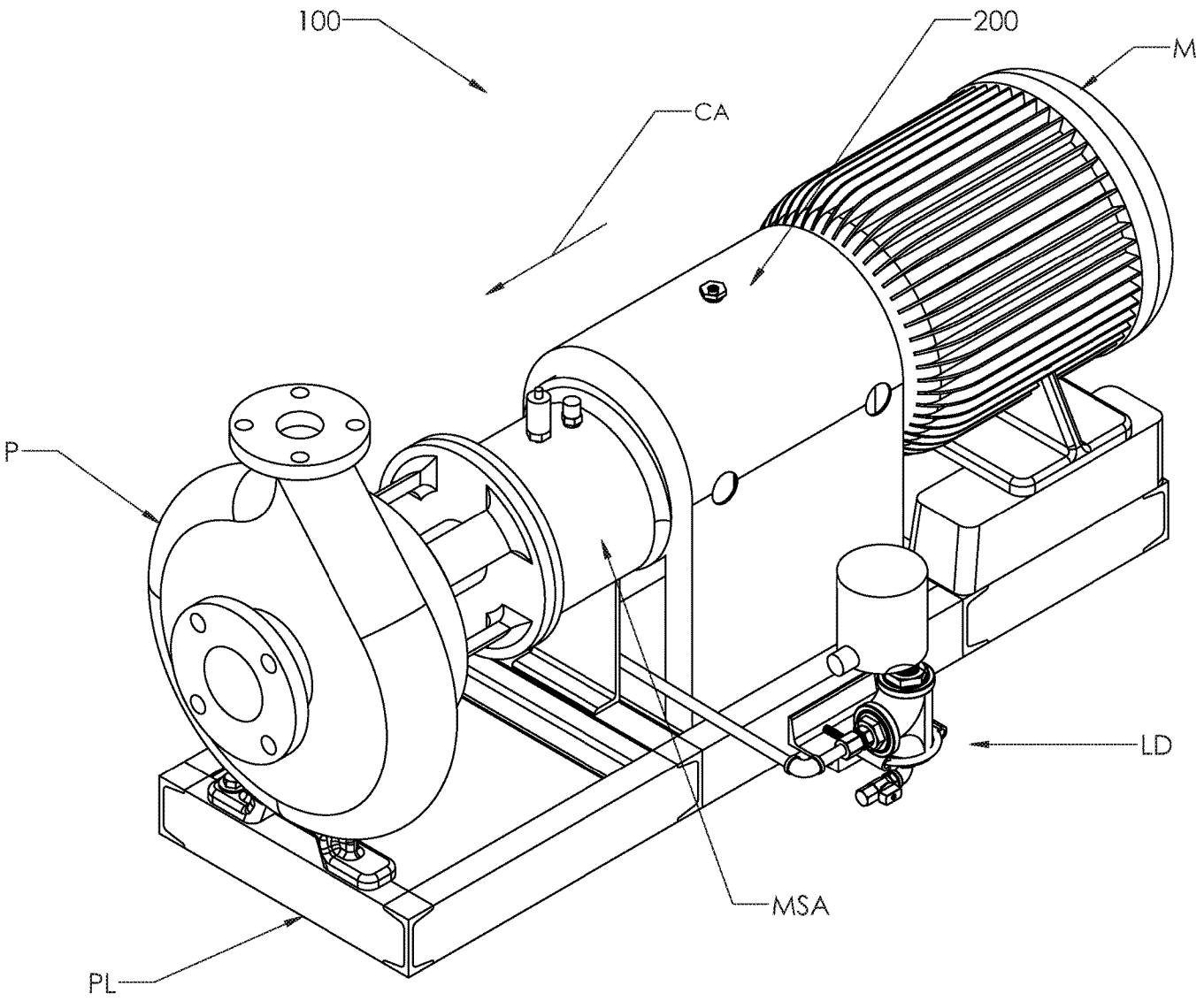
FIG. 1B is a perspective view of an exemplary embodiment of the pump guard fitted to a motor-pump assembly, shown with the outer housing hinged open.
Figure 1C:
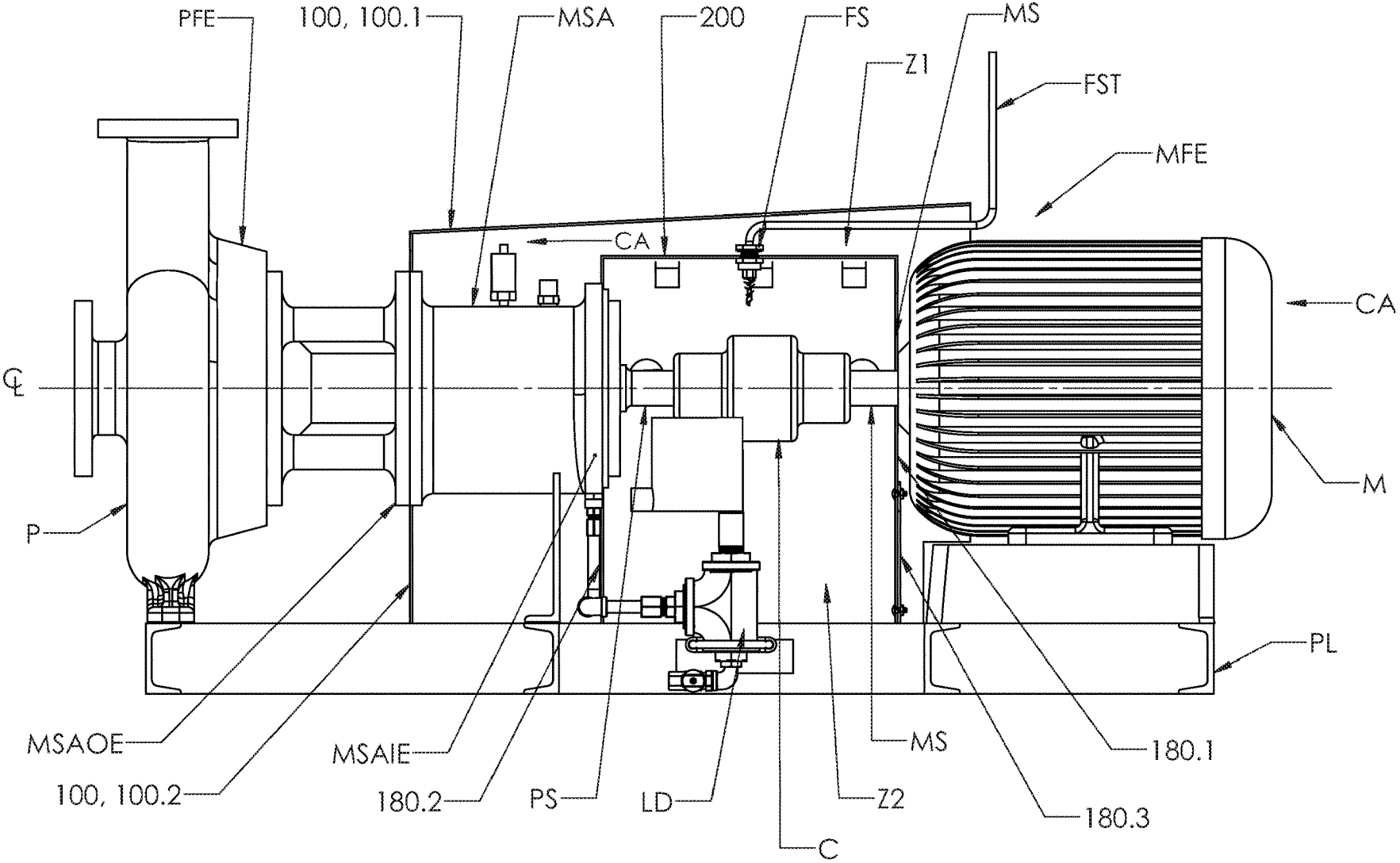
FIG. 1C is a cross-sectional view of an exemplary embodiment of the pump guard and methods of use fitted to a motor-pump assembly, showing the motor coupler and pump mechanical seal assembly.
Figure 2A:
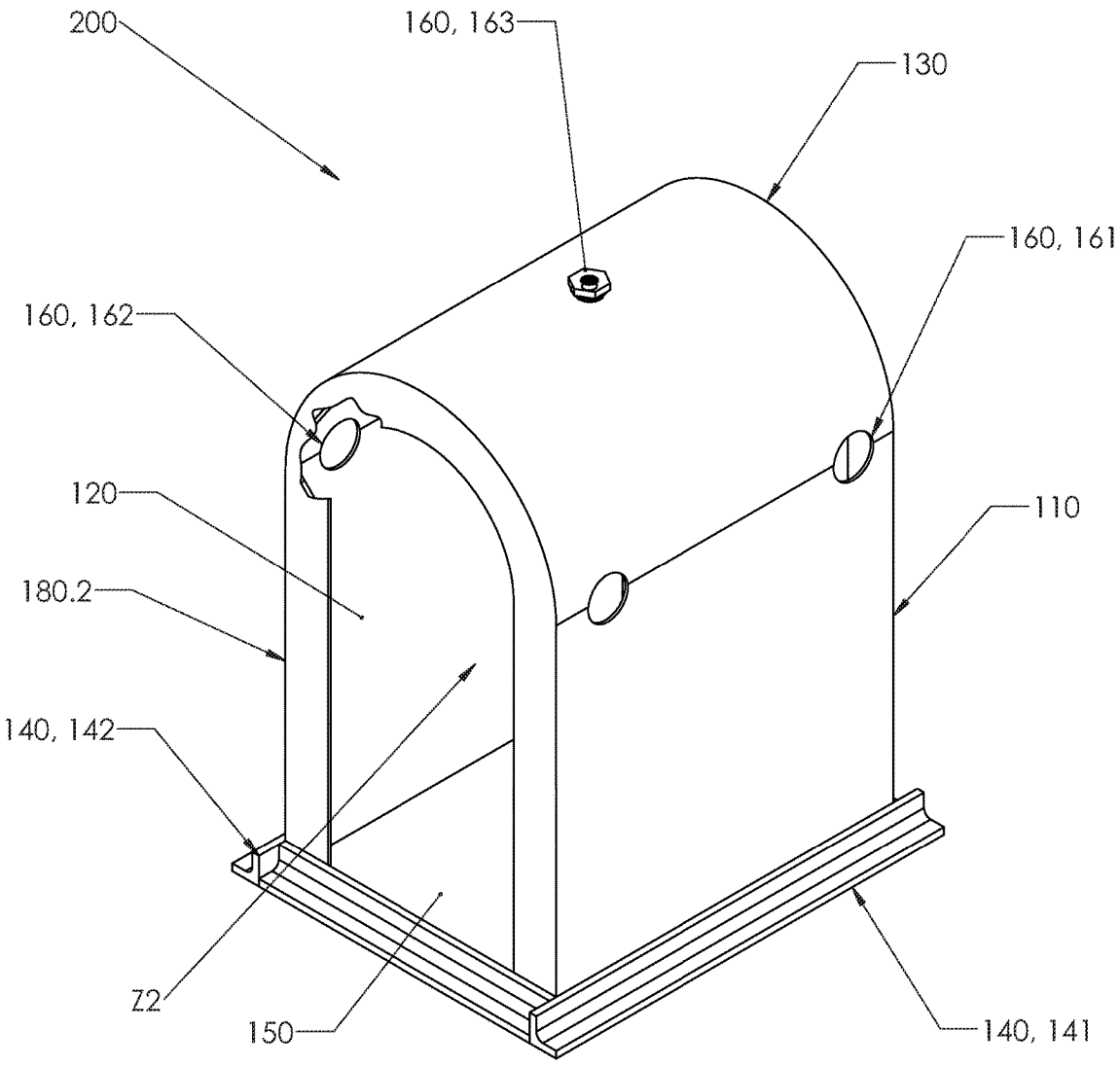
FIG. 2A is a perspective view of an exemplary embodiment of the inner housing of the pump guard and methods of use, according to FIG. 1.
Figure 2B:
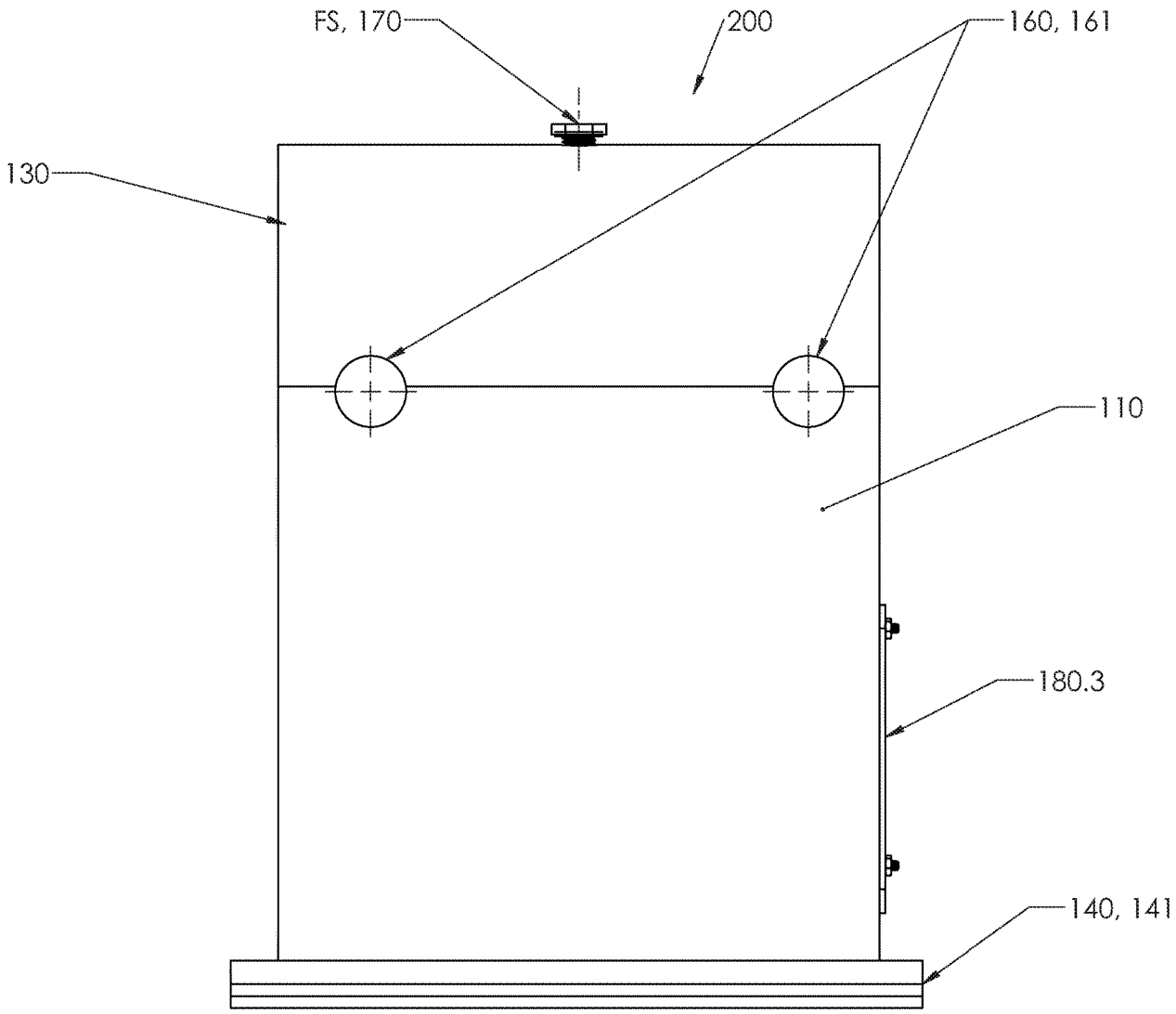
FIG. 2B is a side view of an exemplary embodiment of the inner housing of the pump guard and methods of use, according to FIG. 1.
Figure 2C:
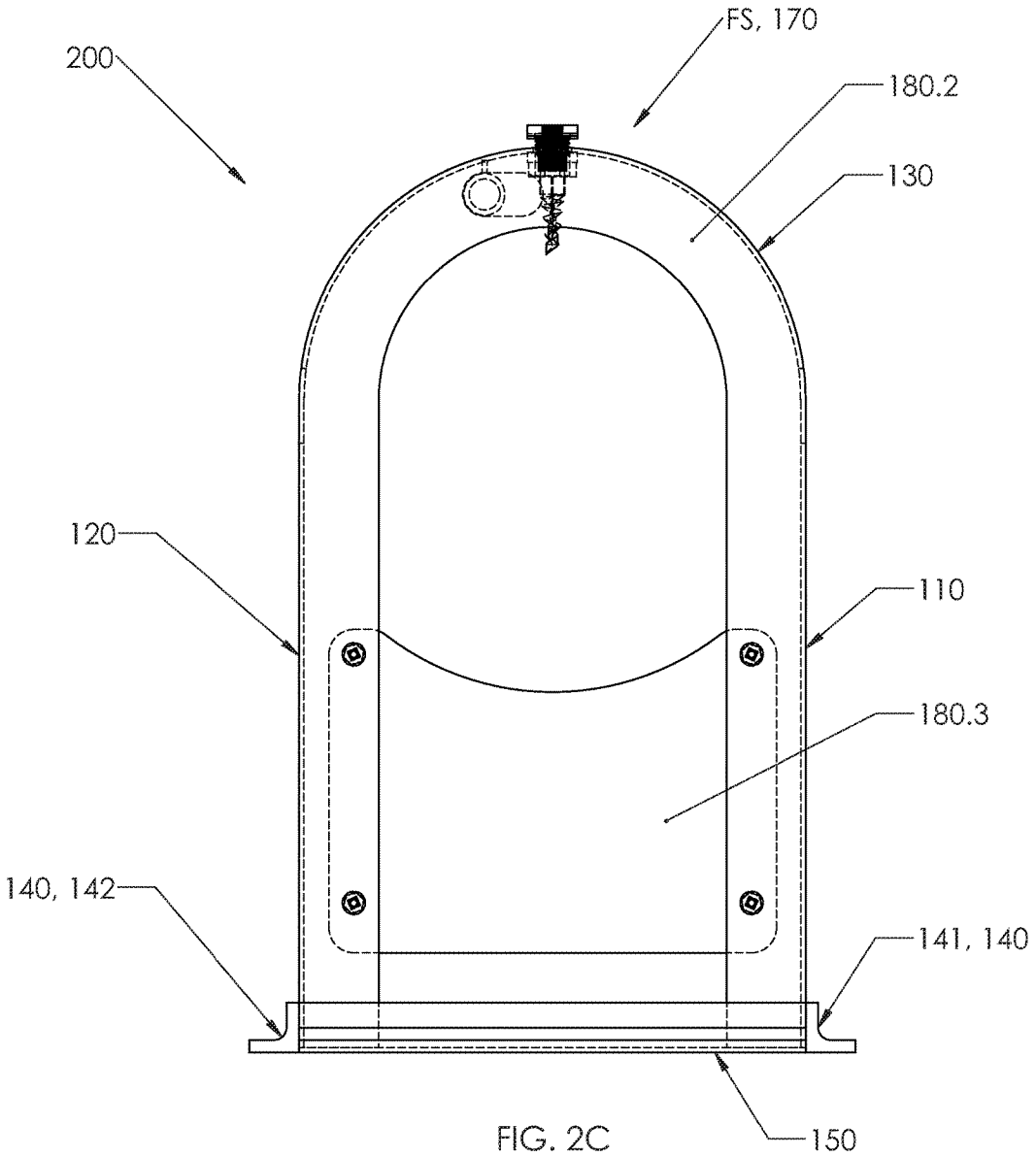
FIG. 2C is an end view of an exemplary embodiment of the inner housing of the pump guard and methods of use, according to FIG. 1.
Figure 2D:
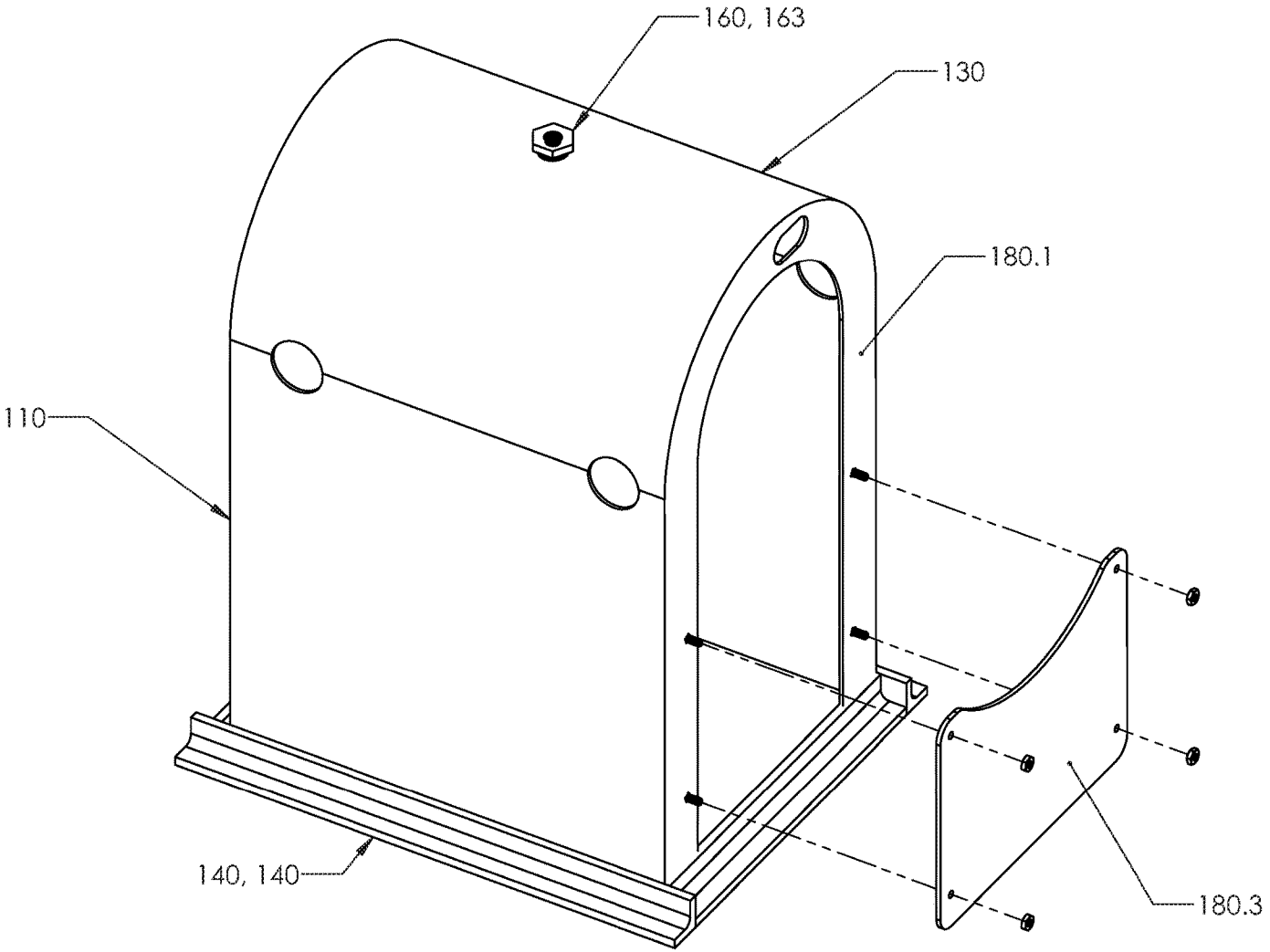
FIG. 2D is a perspective view of an exemplary embodiment of the inner housing of the pump guard and methods of use, according to FIG. 1 with removeable equipment seal.
Figure 2E:
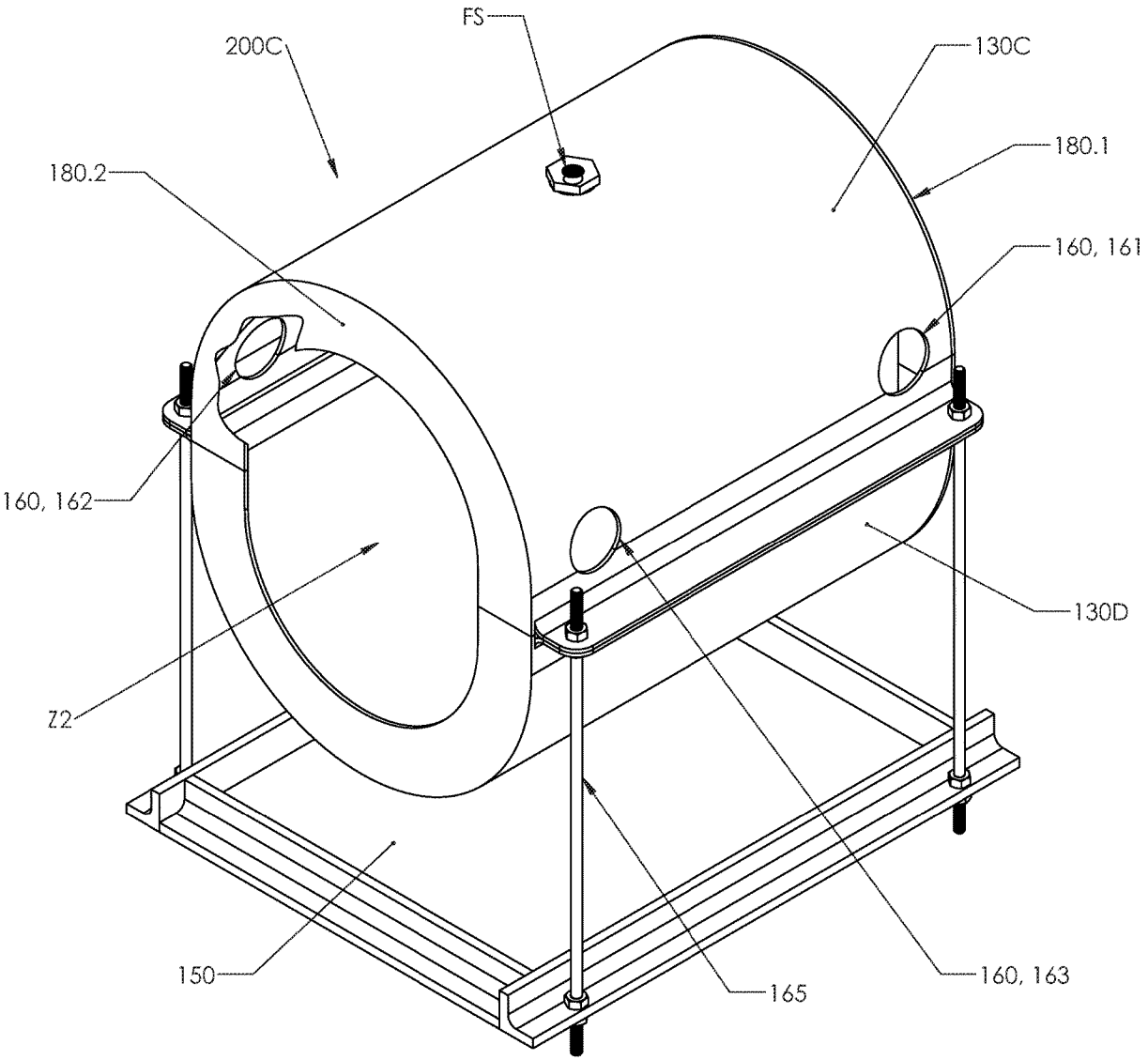
FIG. 2E is a perspective view of an alternate exemplary embodiment of the inner housing of the pump guard and methods of use.
Figure 3A:
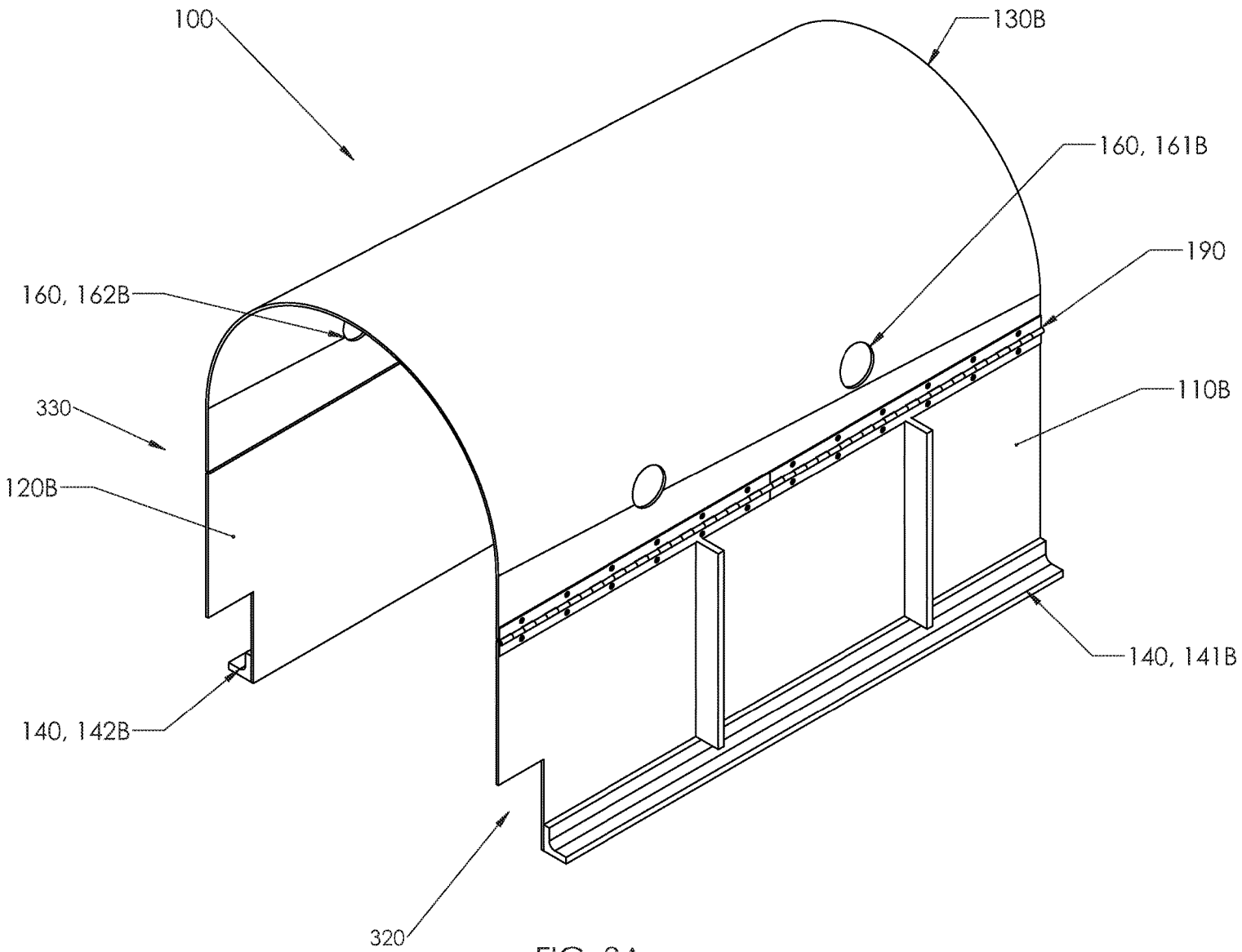
FIG. 3A is a perspective view of an exemplary embodiment of the outer housing of the pump guard and methods of use, according to FIG. 1.
Figure 3B:
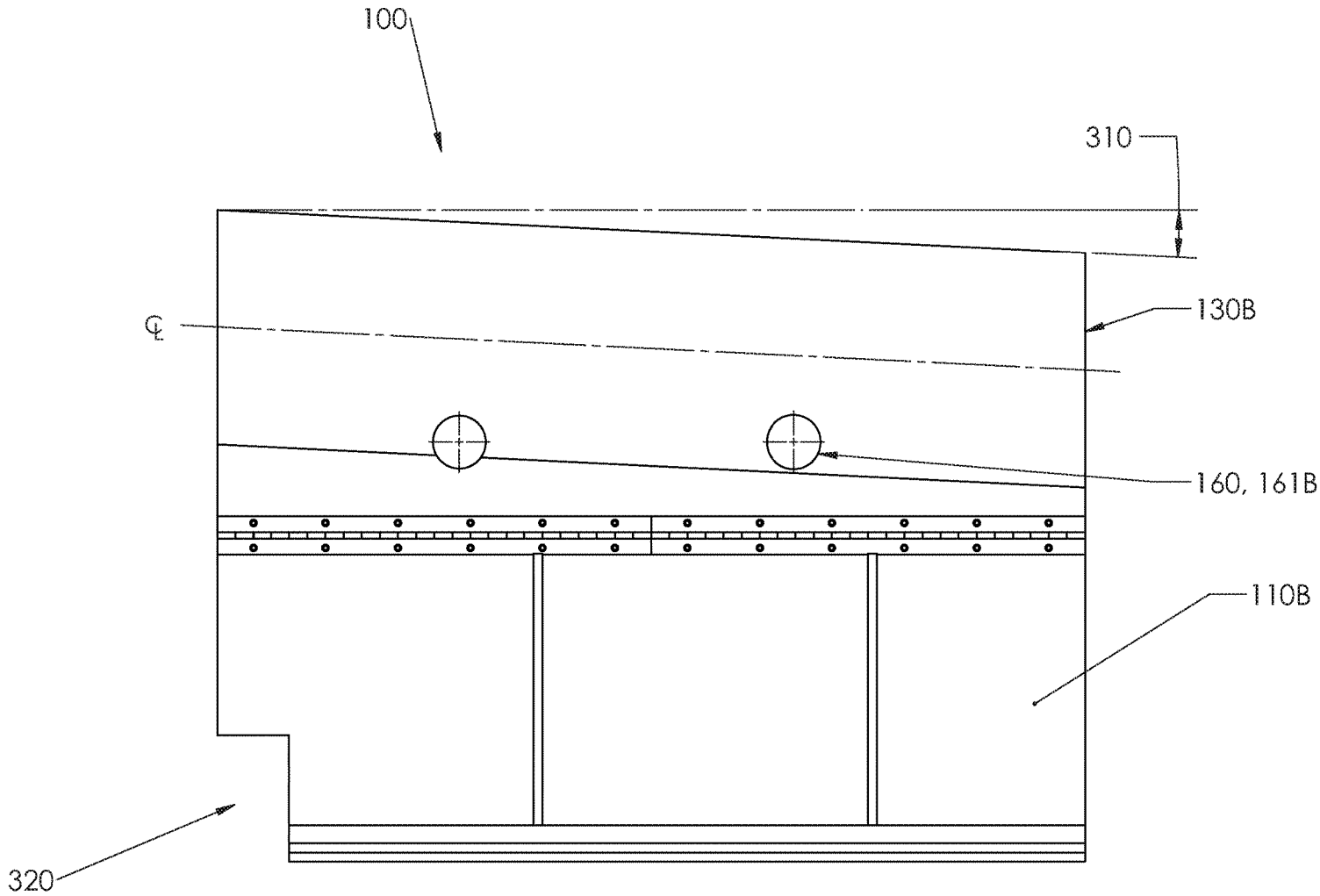
FIG. 3B is a first side view of an exemplary embodiment of the outer housing of the pump guard and methods of use, according to FIG. 1.
Figure 3C:
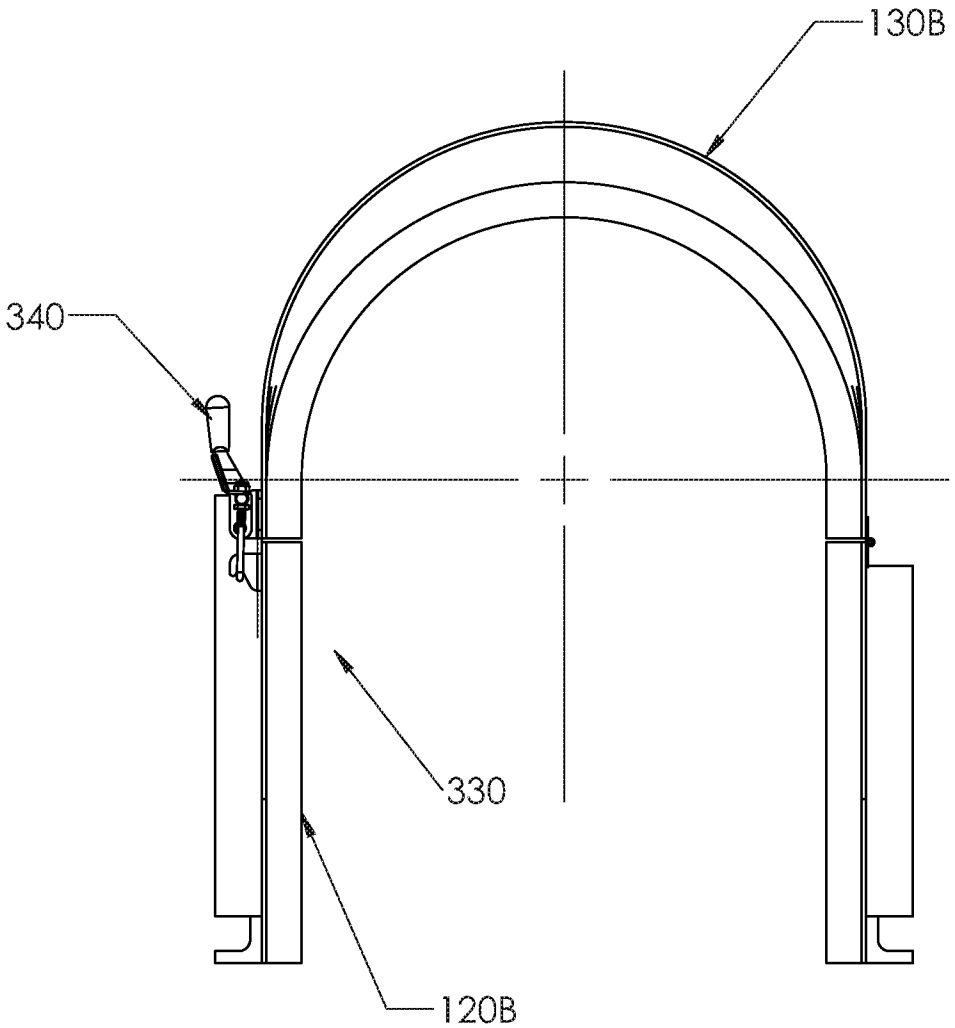
FIG. 3C is an end view of an exemplary embodiment of the outer housing of the pump guard and methods of use, according to FIG. 1.
Figure 3D:
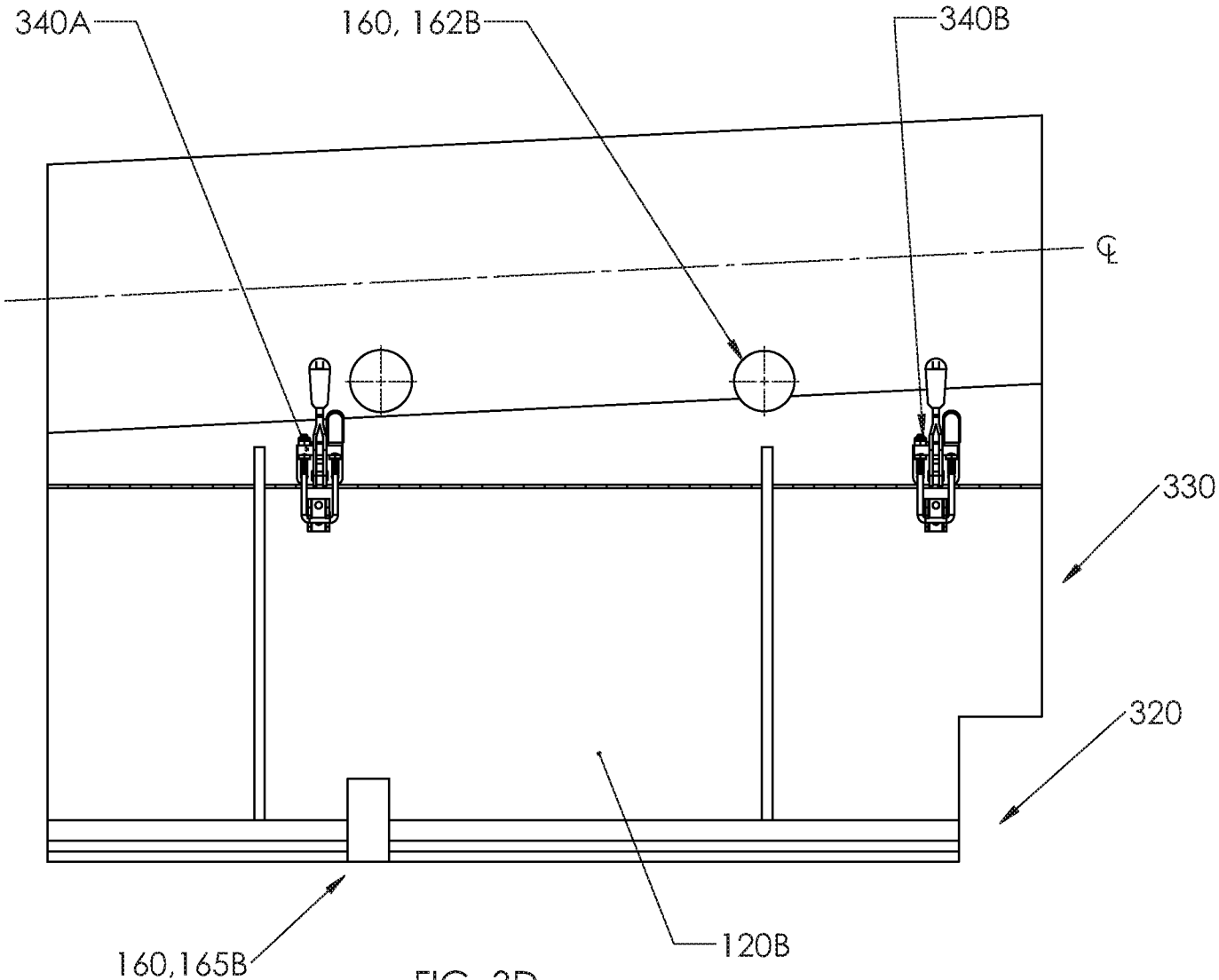
FIG. 3D is a second side view of an exemplary embodiment of the outer housing of the pump guard and methods of use, according to FIG. 1.

Referring now to FIGS. 1A, 1B, and 1C, by way of example, and not limitation, there is illustrated an example embodiment combination housing, cover, shroud, or guard device, such as pump guard 10. Pump guard 10 may be configured of two or more housing, cover, guard, shroud, or isolation zone, such as outer housing, encase, cover, guard, or isolation zone (outer housing) 100 and inner housing, cover, guard, shroud, or isolation zone (inner housing) 200. Both outer housing 100 and inner housing 200 may be positioned to substantially cover, encase, and/or seal pump rotating parts and shaft seal area, such as motor-pump coupler C and pump mechanical seal assembly MSA positioned and mechanically connected therebetween motor M and fluid pump P, and all positioned or resting thereon platform PL. A mechanical seal is an apparatus utilized to contain fluid, within a vessel, such as pumps (especially pumps handling flammable fluids), mixers, or the like where a rotating shaft passes through a stationary housing. A coupler is a mechanical apparatus utilized to connect two rotating shafts together.

Referring again to FIG. 1A, 1B, and 1C which shows a perspective view of pump guard 10 configured with outer housing 100 in a closed or sealed position to cover, shroud, seal therearound, or isolate an area, such as first zone Z1 between approximately motor front edge MFE and extend to mechanical seal assembly outer edge MSAOE and down to platform PL. It is contemplated herein that outer housing 100 may extend thereto pump front edge PFE. Preferably, outer housing 100 and first zone Z1 are configured to capture cooling air CA from the motor fan, or any other fan, and to direct the airflow of cooling air CA over the inner housing toward mechanical seal assembly MSA, pump front edge PFE, and/or pump P to provide the desired cooling effect for the mechanical seal assembly MSA to extend mechanical seal assembly MSA life and to protect mechanical seal assembly MSA from pre-mature failure. Moreover, to provide the desired cooling effect for the pump front edge PFE, and/or pump P to extend pump front edge PFE and/or pump P life and to protect pump front edge PFE and/or pump P from pre-mature failure. It is contemplated herein that outer housing 100 may be configured or sized to fit any variety of motor M and fluid pump P sizes and configurations.

Referring again to FIG. 1B which shows an alternate perspective view of pump guard 10 configured with outer housing 100 in an open or unsealed position exposing inner housing 200 thereunder outer housing 100. Preferably inner housing 100 may be configured in a closed or sealed position to cover, seal therearound, shroud, or isolate an area, such as second zone Z2 between approximately motor front edge MFE or motor shaft MS to mechanical seal assembly inner edge MSAIE and down to platform PL, a foam seal zone. It is recognized herein that inner housing 100 may substantially cover, encase, and/or seal motor-pump rotating parts and shaft seal area. It is contemplated herein that inner housing 200 may extend to cover mechanical seal assembly MSA and thereto pump front edge PFE. Preferably, inner housing 100 and second zone Z2 are configured to isolate rotating units of the pump-motor coupling, mechanical seal assembly MSA to limit access to rotating components and prevent spread of any fires from the mechanical seal MSA area where a leak or fire may occur. It is further contemplated herein that inner housing 200 and second zone Z2 may extend thereto pump front edge PFE to prevent spread of any fires from pump front edge PFE area where a leak or fire may occur. It is further contemplated herein that inner housing 200 may be configured or sized to fit any variety of motor M, motor-pump coupler C, and pump mechanical seal MSA sizes and configurations. It is still further contemplated herein that inner housing 200 and second zone Z2 may be configured to enable leak detection equipment LD sealed access therein.

Referring again to FIG. 1C which shows a cross-sectional view of motor M, fluid pump P, motor-pump coupler C, pump mechanical seal assembly MSA, inner housing 200 thereunder outer housing 100, second zone Z2 and first zone Z1, respectively. Inner housing 200 and/or second zone Z2 may include fire protection, suppressing, flame suppressant, and sensing equipment FS to detect, extinguish and prevent spread of any fires and contain any leak therein second zone Z2 (fire protection and containment zone). It is contemplated herein that inner housing 200 and/or second zone Z2 may include a lip or baffle, such as equipment air seal 180 configured as motor side air seal or and pump mechanical seal assembly MSA air seal configured to seal second zone Z2 therearound motor M and pump mechanical seal assembly MSA. Outer housing 100 and/or first zone Z1 may be configured as an "air scoop" to direct forced air, such as cooling air CA from or through motor M and over pump mechanical seal assembly MSA to provide cooling air flow over mechanical seal assembly MSA therein first zone Z1 (air cooling zone). It is contemplated herein that forced air, such as cooling air CA may be from other or an alternate forced air sources. It is further contemplated herein that outer housing 100 and/or first zone Z1 may be extended further to cool other pump parts such as rear housing RH if desired. It is still further contemplated herein that fire protection, suppressing, and sensing equipment FS may include pumps, piping, tubing, nozzles, and the like to sense or detect leaks, smoke, fire, heat therein inner housing 200 and/or second zone Z2 and deliver fire suppressant, such as foam or other extinguishing agents into inner housing 200 and/or second zone Z2.

It is recognized herein that inner housing 200 may be configured or designed to limit ingress of cooling air CA into second zone Z2 to prevent fanning of a fire where a leak induced fire is likely to occur.

Referring now to FIGS. 2A, 2B, 2C, and 2D by way of example, and not limitation, there is illustrated an example embodiment of housing, cover, guard, shroud, or isolation zone, such as inner housing 200. Inner housing 200 may include one or more vertical or upright side walls or panels, such as first inner housing side wall 110 and second inner housing side wall 120. Inner housing 200 may further include angled, curved, or rounded top, such as first arching top 130 connected thereto first inner housing side wall 110 and second inner housing side wall 120. Preferably, first inner housing side wall 110 and second inner housing side wall 120 may include a base, such as platform 150 connected thereto first inner housing side wall 110 and second inner housing side wall 120. Alternatively, first inner housing side wall 110 and second inner housing side wall 120 may include an angled or lipped edge, such as base edge 140 with first base edge 141 connected thereto first inner housing side wall 110 and second base edge 142 connected to second inner housing side wall 120. It is contemplated herein that first inner housing side wall 110 and second inner housing side wall 120 may be affixed or mate thereto platform PL.

Still furthermore, first inner housing side wall 110, second inner housing side wall 120, and first arching top 130B may include one or more edge contours, shapes, or cutouts, configured to accommodate contour differences between motor M, pump mechanical seal MSA, and pump P differences in dimensions, sizes, and configurations shown in FIGS. 1 for the purpose of sealing second zone Z2 and to isolate rotating units of the motor M, pump-motor coupling, coupler C, mechanical seal assembly MSA, and/or pump P to limit access to rotating components and prevent spread of any fires from second zone Z2 and more specifically mechanical seal assembly MSA where a leak or fire may likely occur.

Moreover, first inner housing side wall 110, second inner housing side wall 120, and second arching top 130 may include one or more holes therethrough, such as apertures 160. More specifically, first inner housing side wall 110 may include one or more apertures 161 and second inner housing side wall 120 may include one or more apertures 162 configured to view motor-pump coupler C, pump mechanical seal assembly MSA positioned therein second zone Z2. Furthermore, second arching top 130 may include one or more apertures 163 configured as an instrument access port thereto second zone Z2.

Referring again to FIG. 2C which shows an end view inner housing 200 where one or more apertures 163 of second arching top 130 may be positioned therein fire protection device, fire suppression device, and fire sensing equipment FS, such as foam injection nozzle 170. It is recognized herein that second arching top 130 of inner housing 200 may be equipped with fire protection, suppression, and sensing equipment FS and include a fire suppression agent system/nozzle arrangement and sensing line to provide fire suppression capability therein inner housing 200, should a fire start in this area. It is recognized herein that sensing equipment FS may include monitoring devices, such as temperature sensors, vibration sensors, or leakage detection devices configured for early detection of possible seal leaks. Sensing equipment FS may be connected to a single pump monitoring system or a multipole pump monitoring system.

Moreover, first inner housing side wall 110, second inner housing side wall 120, and second arching top 130 may include one or more end, or a front first and a back second lip, flap, baffle, deflector, or similar airflow or seal limiting device, such as one or more end equipment seals 180 to further limit ingress of cooling air CA into sealed area second zone Z2 and to contain fire suppression foam. Furthermore, equipment air seal 180 may include motor side equipment seal, such as first equipment seal 180.1 configured to seal therearound motor M as motor side air seal and pump mechanical seal assembly MSA air seal, such as second equipment seal 180.2 (shown in FIG. 1C) configured to seal therearound pump mechanical seal assembly MSA as pump mechanical seal assembly MSA air seal. It is contemplated herein that second zone Z2 of inner housing 200 provides a limited volume confined space to improve effectiveness of fire suppression. The isolation of cooling air outside of second zone Z2 prevents further spreading or re-ignition. It is further contemplated herein that second zone Z2 of inner housing 200, which is used to contain drips of leaks therein to prevent drip spread and thereby limit spread of any potential liquid or in the event of fire, spread of fire. Further, the containment area second zone Z2 of inner housing 200 serves to limit the spread of flame suppressing agent which may be in liquid form.

Referring again to FIG. 2D which shows a perspective view of an embodiment of inner housing 200 Inner housing 200 may include removable lip, flap, baffle, deflector, or similar airflow or seal limiting device, such as third equipment seal 180.3 configured to seal therearound motor M or pump mechanical seal assembly MSA as pump mechanical seal assembly MSA air seal. Third equipment seal 180.3 may be removeably affixed thereto first equipment seal 180.1 or second equipment seal 180.2.

Referring again to FIG. 2E which shows a perspective view of an alternate embodiment inner housing 200. Inner housing 200 may include one or more side walls or panels, such as first arching section 130C and second arching section 130D removeably affixed or fitted together to form inner housing 200. First arching section 130C and second arching section 130D may include one or more edge contours, shapes, or cutouts, configured to accommodate contour differences between motor M, pump mechanical seal MSA, and pump P differences in dimensions, sizes, and configurations shown in FIGS. 1 for the purpose of sealing second zone Z2 and to isolate rotating units of the motor M, pump-motor coupling, coupler C, mechanical seal assembly MSA, and/or pump P to limit access to rotating components and prevent spread of any fires from second zone Z2 and more specifically mechanical seal assembly MSA where a leak or fire may likely occur.

Moreover, first arching section 130C and second arching section 130D may include one or more end, or a front first and a back second lip, flap, baffle, deflector, or similar airflow or seal limiting device, such as one or more end equipment seals 180 to further limit ingress of cooling air CA into sealed area second zone Z2 and to contain fire suppression foam. Furthermore, equipment air seal 180 may include motor side equipment seal, such as first equipment seal 180.1 configured to seal therearound motor M as motor side air seal and pump mechanical seal assembly MSA air seal, such as second equipment seal 180.2 (shown in FIG. 1C) configured to seal therearound pump mechanical seal assembly MSA as pump mechanical seal assembly MSA air seal. It is contemplated herein that second zone Z2 of inner housing 200 provides a limited volume confined space to improve effectiveness of fire suppression. The isolation of cooling air outside of second zone Z2 prevents further spreading or re-ignition. It is further contemplated herein that second zone Z2 of inner housing 200, which is used to contain drips of leaks therein to prevent drip spread and thereby limit spread of any potential liquid or in the event of fire, spread of fire. Further, the containment area second zone Z2 of inner housing 200 serves to limit the spread of flame suppressing agent which may be in liquid form.

Furthermore, first arching section 130C and second arching section 130D may include one or more holes therethrough, such as outer housing aperture 160 and be equipped with fire protection, suppression, and sensing equipment FS and include a fire suppression agent system/nozzle arrangement and sensing line to provide fire suppression capability therein inner housing 200, should a fire start in this area. Still furthermore, first arching section 130C and second arching section 130D may be supported above platform 150 by supports 165.

Referring now to FIGS. 3A, 3B, 3C, and 3D, by way of example, and not limitation, there is illustrated an example embodiment of housing, cover, guard, shroud, or isolation zone, such as outer housing 100. Outer housing 100 may include one or more vertical or upright side walls or panels, such as first outer housing side wall 110B and second outer housing side wall 120B. Outer housing 100 may further include angled, curved, or rounded top, such as first arching top 130B connected thereto first outer housing side wall 110B and second outer housing side wall 120B. Preferably, first outer housing side wall 110B and second outer housing side wall 120B may include angled or lipped edge, such as base edge 140 with first base edge 141B connected thereto first outer housing side wall 110B and second base edge 142B connected to second outer housing side wall 120B. It is contemplated herein that first inner housing side wall 110 and second inner housing side wall 120 may be affixed or mate thereto platform PL. Alternatively, first outer housing side wall 110B and second outer housing side wall 120B may include a base, such as platform PL (like platform 150 in FIG. 2) connected thereto first outer housing side wall 110B and second outer housing side wall 120B.

Moreover, first outer housing side wall 110B, second outer housing side wall 120B, and first arching top 130B may include one or more holes therethrough, such as outer housing aperture 160. More specifically, first outer housing side wall 110B may include one or more apertures 161B and second outer housing side wall 120B may include one or more apertures 162B configured to view inner housing 200 or one or more apertures 161 and one or more apertures 162 of FIGS. 2, and therethrough to view motor-pump coupler C, pump mechanical seal assembly MSA positioned therein second zone Z2. Furthermore, first arching top 130B may include one or more hinges 190 hingedly connected therebetween first arching top 130B and first outer housing side wall 110B to enable hinged access thereto first zone Z1 and inner housing 200, as shown hinged open in FIG. 1B. Still furthermore, first outer housing side wall 110B, second outer housing side wall 120B, and first arching top 130B may include one or more edge cutouts, such as notch 320 configured to accommodate contour differences between motor M, pump mechanical seal MSA, and pump P differences in dimensions, sizes, and configurations shown in FIGS. 1 for the purpose of sealing first zone Z1 and directing forced air, such as cooling air CA from or through motor M and over mechanical seal assembly MSA to provide cooling air flow over mechanical seal assembly MSA.

Referring again to FIG. 3B which shows a first side view of outer housing 100 and more specifically first outer housing side wall 110B. First arching top 130B may be configured slanted or sloped at an angle 310 to accommodate height differences between motor M, motor-pump coupler C, pump mechanical seal MSA, and pump P differences in dimensions, sizes, and configurations shown in FIGS. 1. Moreover, outer housing 100 may be configured as a converging section but may be comprised of any shape suitable to direct air flow from motor M therethrough outer housing 100, which may include, but not be limited to, straight sections, conical section, or combinations of straight section and converging sections.

Referring again to FIG. 3C which shows an end view of first outer housing 100 where seam 330 between first arching top 130B and second outer housing side wall 120B comes in contact therebetween. Moreover, one or more latch mechanism 340 may releasably affix first arching top 130B thereto second outer housing side wall 120B across seam 330 between.

Referring again to FIG. 3D which shows a second side view of outer housing 100 and more specifically second outer housing side wall 120B. Moreover, one or more latch mechanism 340, such as first latch mechanism 340A and second latch mechanism 340B releasably affix first arching top 130B thereto second outer housing side wall 120B across seam 330 between.

Outer housing 100 and inner housing 200 may be formed of any airtight, heat resistant, and/or corrosion resistant material, capable of creating a fire sealed area and directing airflow through a designated pathway. Moreover, outer housing 100 and inner housing 200 may preferably be constructed of stainless steel, aluminum, heat resistant fiberglass, plastic, as these materials offers a variety of forms and shapes; however, other suitable materials such as metal, concrete, composite, and the like, formed of multiple layers with different materials, or the like, may be utilized, provided such material has sufficient strength and/or durability as would meet the purpose described herein.

It is contemplated herein that outer housing 100 and inner housing 200 may be configured in other shapes other than a trough, such as rectangle, tube, or channel.

Figure 4:
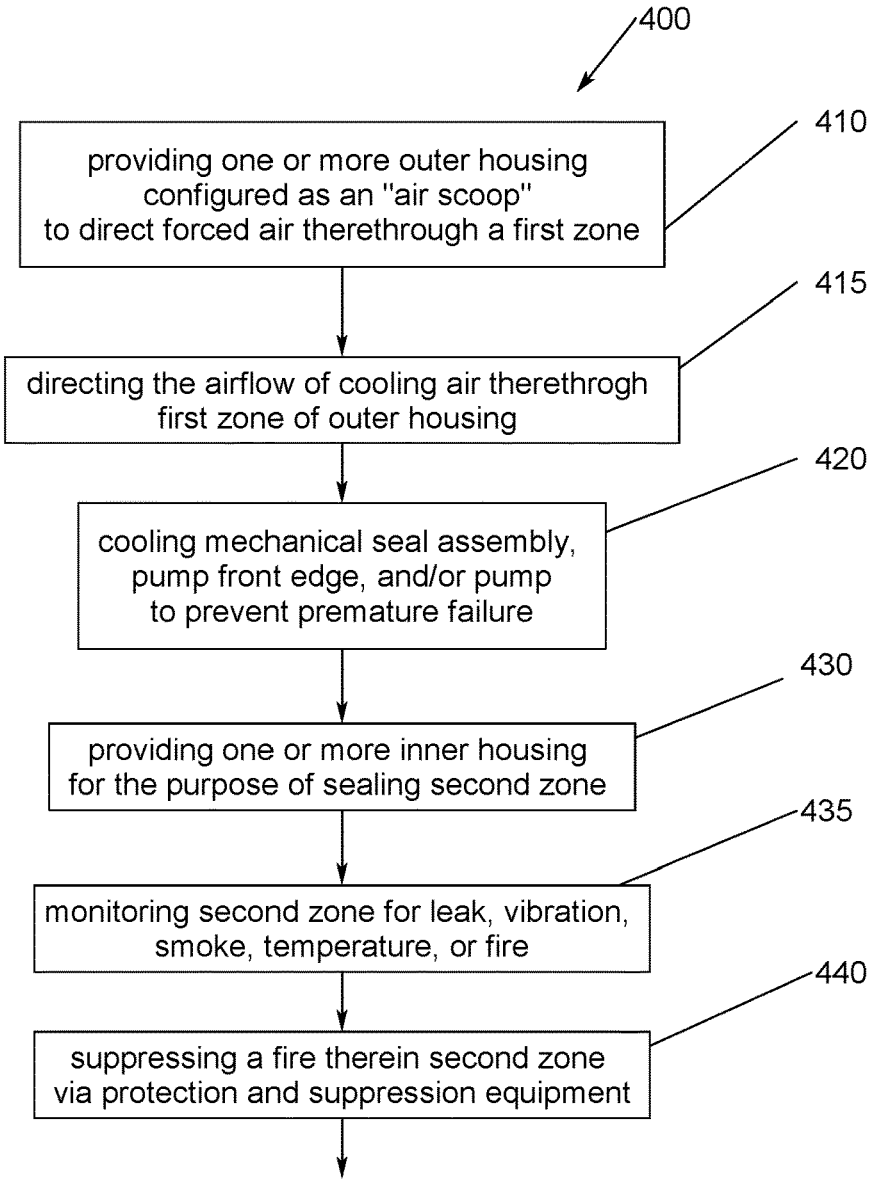
FIG. 4 is a flow diagram of a method of filtering a portion of suspended substances and/or dissolved substances from an effluent.

Referring now to FIG. 4, there is illustrated a flow diagram 400 of a method of use of pump guard 10. In block or step 410, providing one or more outer housing 100 configured as an "air scoop" to direct forced air, such as cooling air CA from or through motor M and over mechanical seal assembly MSA to provide cooling air flow over mechanical seal assembly MSA therethrough first zone Z1 (air cooling zone). In block or step 415, directing the airflow of cooling air CA therethrogh first zone Z1 of outer housing 100 and toward mechanical seal assembly MSA, pump front edge PFE, and/or pump P. In block or step 420, cooling mechanical seal assembly MSA, pump front edge PFE, and/or pump P to provide the desired cooling effect for the mechanical seal assembly MSA to extend mechanical seal assembly MSA life and to protect mechanical seal assembly MSA from pre-mature failure.

In block or step 430, providing one or more inner housing 200 for the purpose of sealing second zone Z2 and to isolate rotating units of the motor M, pump-motor coupling, coupler C, mechanical seal assembly MSA, and/or pump P to limit access to rotating components and prevent spread of any fires from second zone Z2, and more specifically mechanical seal assembly MSA where a leak or fire may likely occur and for the purpose of fire protection, suppression, and sensing. In block or step 435, monitoring second zone Z2 for leak, vibration, smoke, temperature, or fire therein via fire protection and sensing equipment FS, such as foam injection nozzle 170 and alarming if such detection is positive. It is recognized herein that second arching top 130 of inner housing 200 may be equipped with fire protection and sensing equipment FS and include a fire sensing line to provide fire suppression capability therein inner housing 200, should a fire start in this area. In block or step 440, suppressing a fire therein second zone Z2 via foam fire protection or other fire suppressant, isolation, and suppression equipment FS, such as foam injection nozzle 170 and suppression agent system/nozzle arrangement to provide fire suppression capability therein inner housing 200, should a fire start in this area and isolating second zone Z2 from first zone Z1.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments of the disclosure will come to mind to one ordinarily skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein, but is limited only by the following claims.

What is claimed is:

1. A shroud of a motor, a motor-pump coupler, a pump mechanical seal assembly, and a pump, the shroud comprising:

an outer housing configured as an air scoop having a first zone to direct cooling air from the motor over the pump mechanical seal assembly, the outer housing formed of a first outer housing side wall and a second outer housing side wall, and a first arching top connected thereto said first outer housing side wall and said second outer housing side wall; and an inner housing positioned within said outer housing and configured to seal a second zone therearound the motor, the motor-pump coupler, and the pump mechanical seal assembly, said inner housing formed of a platform, extending therefrom a first inner housing side wall and a second inner housing side wall, and a second arching top connected thereto said first inner housing side wall and said second inner housing side wall, and one or more end equipment seals connected thereto said platform, said first inner housing side wall and said second inner housing side wall, and said second arching top.

2. The shroud of claim 1, further comprises a first base edge connected thereto said first outer housing side wall and a second base edge connected to said second outer housing side wall.

3. The shroud of claim 1, further comprises an outer housing aperture configured to view said inner housing.

4. The shroud of claim 1, further comprises one or more hinges hingedly connected therebetween said first arching top and said first outer housing side wall to enable hinged access thereto said inner housing.

5. The shroud of claim 1, further comprises one or more edge cutouts configured therein said first outer housing side wall and said second outer housing side wall to accommodate contour differences between the motor, the pump mechanical seal assembly, and the pump.

6. The shroud of claim 1, wherein said first arching top is configured slanted at an angle to accommodate height differences between the motor and the pump mechanical seal assembly.

7. The shroud of claim 1, further comprises one or more latch mechanism configured to affix said first arching top thereto said second outer housing side wall.

8. The shroud of claim 1, further comprises one or more edge cutouts configured therein said first inner housing side wall and said second inner housing side wall to accommodate contour differences between the motor, and the pump mechanical seal assembly.

9. The shroud of claim 1, wherein said one or more end equipment seals further comprises a baffle.

10. The shroud of claim 1, wherein said inner housing and said second zone are configured to isolate the motor, the motor-pump coupler, and the mechanical seal assembly to prevent spread of any fires from said second zone.

11. The shroud of claim 1, further comprises an inner housing aperture configured to view therein said second zone.

12. The shroud of claim 11, wherein said inner housing aperture further comprises an instrument access port.

13. The shroud of claim 12, wherein said instrument access port includes a fire suppression device.

14. The shroud of claim 13, wherein said fire suppression device includes a flame suppressant.

15. The shroud of claim 12, wherein said instrument access port includes fire sensing equipment.

16. A fire containment and cooling system, said system comprising:

a motor;

a motor-pump coupler;

a pump mechanical seal assembly;

a pump;

an outer housing configured as an air scoop having a first zone to direct cooling air from said motor over said pump mechanical seal assembly, said outer housing formed of a first outer housing side wall and a second outer housing side wall, and a first arching top connected thereto said first outer housing side wall and said second outer housing side wall; and an inner housing positioned within said outer housing and configured to seal a second zone around said motor, said motor-pump coupler, and said pump mechanical seal assembly, said inner housing formed of a platform, extending therefrom a first inner housing side wall and a second inner housing side wall, and a second arching top connected thereto said first inner housing side wall and said second inner housing side wall, and one or more end equipment seals connected thereto said platform, said first inner housing side wall and said second inner housing side wall, and said second arching top.

17. The fire containment and cooling system of claim 16, wherein said inner housing and said second zone are configured to isolate said motor, said motor-pump coupler, and said mechanical seal assembly to prevent spread of any fires from said second zone.

18. The fire containment and cooling system of claim 16, further comprises an inner housing aperture configured to view therein said second zone.

19. The fire containment and cooling apparatus of claim 18, wherein said inner housing aperture further comprises an instrument access port.

20. The fire containment and cooling system of claim 19, wherein said instrument access port includes a fire suppression device.

21. The fire containment and cooling system of claim 20, wherein said fire suppression device includes a foam injection nozzle.

22. The fire containment and cooling system of claim 19, wherein said instrument access port includes fire sensing equipment.

* * * * *